US005430422A

United States Patent [19]

Gibson

[11] Patent Number: 5,430,422

[45] Date of Patent: Jul. 4, 1995

[54] CIRCUIT BREAKER WITH ANTI-SHOCK-OFF BLOCKING MECHANISM

[75] Inventor: Perry R. Gibson, Beaver Falls, Pa.

[73] Assignee: Eaton Corporation, Cleveland, Ohio

[21] Appl. No.: 182,959

[22] Filed: Jan. 14, 1994

[51] Int. Cl.[6] ..... H01H 9/00

[52] U.S. Cl. ..... 335/172; 335/166; 335/176

[58] Field of Search ..... 335/167–176, 335/23, 24, 25, 166

[56] References Cited

U.S. PATENT DOCUMENTS

| | | | |
|---|---|---|---|
| 3,305,806 | 2/1967 | Norden | 335/172 |
| 3,605,052 | 9/1971 | Diamond et al. | 335/166 |
| 4,489,295 | 12/1984 | Altenhof, Jr. et al. | 335/20 |
| 5,200,724 | 4/1993 | Gula et al. | 335/166 |

*Primary Examiner*—Lincoln Donovan
*Attorney, Agent, or Firm*—Martin J. Moran

[57] ABSTRACT

A circuit breaker includes a housing; separable electrical contacts; an operating mechanism having a handle arm for operation and also having ON, trip, OFF and reset positions; a trip mechanism for tripping the operating mechanism to the trip position in response to a predetermined electrical condition of the separable contacts; and a blocking mechanism for blocking movement of the operating mechanism, beyond the OFF position and toward the reset position, when the operating mechanism is moved from the ON to the OFF position. The circuit breaker may also have a latch mechanism for latching the operating mechanism when it is not in the trip position, a reset mechanism for resetting the latch, and a cradle mechanism which is latched by the latch. The blocking mechanism may be pivotally connected to a knee-pin of the operating mechanism and the cradle may have a cross-pin cooperating with the blocking mechanism. The blocking mechanism may further hold the cradle when the operating mechanism is moved from the ON position to the OFF position and cam off of the cradle when the operating mechanism is moved to the reset position. The blocking mechanism may also have an arcuate surface for holding the cradle and a camming surface for camming off of the cross-pin of the cradle. The circuit breaker may further include a spring mechanism cooperating with the blocking mechanism to permit blocking operation independent of circuit breaker orientation. The spring mechanism may be connected to a second cross-pin of the cradle. The spring mechanism may further engage an arcuate surface of the blocking mechanism.

19 Claims, 10 Drawing Sheets

CIRCUIT BREAKER WITH ANTI-SHOCK-OFF BLOCKING MECHANISM

BACKGROUND OF THE INVENTION

1. Field of the Invention

This invention is directed to electrical circuit breakers, and more particularly to electrical circuit breakers which incorporate a blocking mechanism for restricting travel of a cradle assembly of the circuit breaker during ON to OFF operation without affecting normal reset or trip operation of the circuit breaker.

2. Background of Information

Molded case circuit breakers are generally old and well known in the art. Examples of such circuit breakers are disclosed in U.S. Pat. Nos. 4,489,295; 4,638,277; 4,656,444; and 4,679,018. Such circuit breakers are used to protect electrical circuitry from damage due to an overcurrent condition, such as an overload and relatively high level short circuit. An overload condition is about 200–300% of the nominal current rating of the circuit breaker. A high level short circuit condition can be 1000% or more of the nominal current rating of the circuit breaker.

Molded case circuit breakers include a pair of separable contacts per phase which may be operated either manually by way of a handle disposed on the outside of the case or automatically in response to an overcurrent condition. In the automatic mode of operation the contacts may be opened by an operating mechanism or by a magnetic repulsion member. The magnetic repulsion member causes the contacts to separate under relatively high level short circuit conditions. More particularly, the magnetic repulsion member is connected between a pivotally mounted contact arm and a stationary conductor. The magnetic repulsion member is a generally V-shaped member defining two legs. During high level short circuit conditions, magnetic repulsion forces are generated between the legs of the magnetic repulsion member as a result of the current flowing therethrough which, in turn, causes the pivotally mounted contact arm to open.

In a multi-pole circuit breaker, such as a three-pole circuit breaker, three separate contact assemblies, one for each pole, having magnetic repulsion members are provided. The contact arm assemblies are operated independently by the magnetic repulsion members. For example, for a high level short circuit on the A phase, only the A phase contacts would be blown open by its respective magnetic repulsion member. The magnetic repulsion members for the B and C phases would be unaffected by the operation of the A phase contact assembly. The circuit breaker operating mechanism is used to trip the other two poles in such a situation. This is done to prevent a condition known as single phasing, which can occur for circuit breakers connected to rotational loads, such as motors. In such a situation, unless all phases are tripped, the motor may act as a generator and feed the fault.

In the other automatic mode of operation, the contact assemblies for all three poles are tripped together by a current sensing circuit and a mechanical operating mechanism. More particularly, current transformers are provided within the circuit breaker housing to sense overcurrent conditions. When an overcurrent condition is sensed, the current transformers provide a signal to electronic circuitry which actuates the operating mechanism to cause the contacts to be separated.

The operating mechanism of the circuit breaker is designed to rapidly open and close the separable contacts, thereby preventing a moveable contact from stopping at any position which is intermediate a fully open or fully closed position.

The circuit breaker includes a pivoting operating handle, which projects through an opening formed in the breaker housing, for manual operation. The handle may assume one of four positions during normal operation of the circuit breaker. In an ON position, the handle is positioned at one end of its permissible travel. When the operating handle is moved to this position, and the breaker is not tripped, the contacts of the circuit breaker close, thereby allowing electrical current to flow from a current source to an associated electrical circuit. Near the opposite end of travel of the handle is an OFF position. When the handle is moved to that position, the contacts of the circuit breaker open, thereby preventing current from flowing through the circuit breaker.

A third position is a trip position which is approximately midway between the ON position and the OFF position. The handle automatically assumes this position whenever the operating mechanism has tripped the circuit breaker and opened the contacts. Once the circuit breaker has been tripped, the electrical contacts cannot be reclosed until the operating handle is first moved to a fourth reset position and then back to the ON position.

The reset position, which is beyond the OFF position, is at the opposite end of travel of the handle with respect to the ON position. When the handle is moved to the reset position, a trip mechanism is reset in preparation for reclosure of the contacts when the handle is moved back to the ON position.

A typical example of a circuit breaker is disclosed in U.S. Pat. Nos. 5,200,724 issued Apr. 6, 1993 to Lance Gula et al. entitled "Electrical Circuit Breaker Operating Handle Block" and assigned to the assignee of the present invention, which is herein incorporated by reference.

Whenever the handle is in the ON position, biasing springs connected to the handle provide a biasing force to a pivot point. The pivot point pivotally connects upper and lower links of a toggle mechanism. The lower toggle link is also pivotally connected to an arm carrier carrying the movable main contacts. The upper toggle link is pivotally connected to a cradle which can be latched by a cradle latch mechanism which cooperates with the trip mechanism. When the circuit breaker is tripped, and the cradle is unlatched, the cradle rotates under the influence of the biasing springs. With the rotation of the cradle, the biasing springs also cause the collapse of the toggle mechanism. In turn, this causes the separation of the main contacts.

After a trip, whenever the handle is rotated toward the reset position, an internal reset pin interconnected with the handle rotates toward a surface of the cradle. As the reset pin engages this surface, the cradle, which is in an unlatched position, is rotated toward a latched position. As the cradle rotates, it engages a lever of a reset mechanism. The reset mechanism rotates a trip bar to engage the cradle latch mechanism. In turn, the latch mechanism latches the cradle in its latched position. After this reset operation, the circuit breaker handle may be moved to the ON position, thereby closing the contacts.

Under manual operation of the circuit breaker, whenever the handle is moved from the ON to the OFF position, the combination of the handle in conjunction with the attached biasing springs operate to separate the movable main contacts from the fixed main contacts of the circuit breaker. As the handle is moved, the biasing force of the biasing springs causes the collapse of the toggle mechanism. The biasing force also causes the upper toggle link to pivot in one direction about the pivot point. In a related manner, the lower toggle link pivots in the opposite direction about the pivot point. The lower toggle link, in turn, raises the arm carrier which separates the main contacts.

When the toggle mechanism collapses, as the handle is manually moved toward the OFF position, the stored energy in the spring provides additional force, beyond the force of manual operation, to further rotate the handle toward the OFF position. As the handle rotates, the handle reset pin also rotates toward the cradle surface in a manner similar to the reset operation described above. As the reset pin engages the cradle surface, the cradle, which is in its latched position, is rotated in a comparable manner as the reset operation. As the cradle is rotated, beyond its latched position, it reaches its reset position. In a manner similar to the reset operation, the cradle engages the lever of the reset mechanism and rotates the trip bar to engage the latch mechanism. At this point, the reset mechanism cannot adversely affect normal operation of the circuit breaker. This is because, during the reset operation preceding the placement of the handle in the ON position, the latch mechanism had engaged the cradle in its latched position.

However, some conditions, that need improvement, may result whenever the handle is moved from the ON to the OFF position. In particular, whenever the trip bar is rotated by the lever of the reset mechanism, an over-travel spring of the trip bar is compressed. Furthermore, tripping mechanisms connected to the trip bar, such as a flux transfer shunt trip and an attachment tab, are also compressed. In turn, the compression of the over-travel spring and the tripping mechanisms causes a counter-rotation of the trip bar. Under certain circumstances, such counter-rotation causes the trip bar to reach a trip position. Under such circumstances, the latch mechanism unlatches the cradle and, thus, the circuit breaker enters the trip position. This necessitates a reset of the circuit breaker before the circuit breaker can be placed in the intended OFF position.

There is a need, therefore, for a mechanism that prevents the cradle from entering the trip position during manual operation of the circuit breaker handle from the ON to the OFF position.

There is a more particular need for such a mechanism that does not affect normal reset operation of the circuit breaker.

There is also a more particular need for such a mechanism that does not affect the operation or loading of the circuit breaker tripping mechanisms.

There is yet another more particular need for such a mechanism that does not alter the handle forces required for ON to OFF, or trip to reset, operation of the circuit breaker.

There is still another more particular need for such a mechanism that withstands handle forces during OFF to reset operation, after ON to OFF operation, of the circuit breaker.

SUMMARY OF THE INVENTION

These and other needs are satisfied by the invention which is directed to an electrical circuit breaker incorporating a blocking mechanism which restricts travel of the circuit breaker cradle during ON to OFF operation without affecting normal reset or trip operation of the circuit breaker. In accordance with the invention, a circuit breaker having a housing, a pair of separable contacts per phase, and an operating mechanism including a handle arm for operation, a toggle assembly and a cradle for tripping the separable contacts, is provided with a blocking mechanism, pivotally mounted to a knee-pin of the toggle assembly, for blocking movement of the cradle under specific circumstances. The cradle, however, operates independently from the blocking mechanism under other circumstances.

In particular, the operating mechanism has an ON position for closing the separable contacts, a trip position where the contacts are open, an OFF position for opening the contacts, and a reset position for resetting a latch mechanism associated with a trip mechanism. Whenever the operating mechanism is moved from the ON position to the OFF position, an arcuate blocking surface of the blocking mechanism captures a cross-pin of the cradle and prevents movement of the cradle beyond a latched position to a reset position. The blocking mechanism, thus, provides positive protection against a lost latch condition whenever the circuit breaker handle is manually moved from the ON to the OFF position.

In contrast, whenever the operating mechanism is moved from the trip position to the reset position, a camming surface of the blocking mechanism cams off of the cross-pin of the cradle. This permits movement of the cradle beyond its latched position to its reset position. In particular, the handle of the operating mechanism rotates a handle reset pin. The reset pin rotates toward and engages a surface of the cradle. While the camming surface continues to cam off of the cross-pin of the cradle, the reset pin rotates the cradle to its reset position. Thus, the blocking mechanism does not affect normal reset operation of the circuit breaker. The blocking mechanism, which merely captures the cradle during ON to OFF manual operation, does not affect the operation or loading of the circuit breaker tripping mechanisms. Moreover, because the blocking mechanism is generally independent of the handle, the blocking mechanism does not alter the handle forces required for ON to OFF, or trip to reset, operation of the circuit breaker. Furthermore, after ON to OFF operation, whenever the handle is moved from the OFF position to the reset position, the blocking mechanism sustains handle forces between the captured cross-pin of the cradle and the knee-pin of the upper toggle link.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
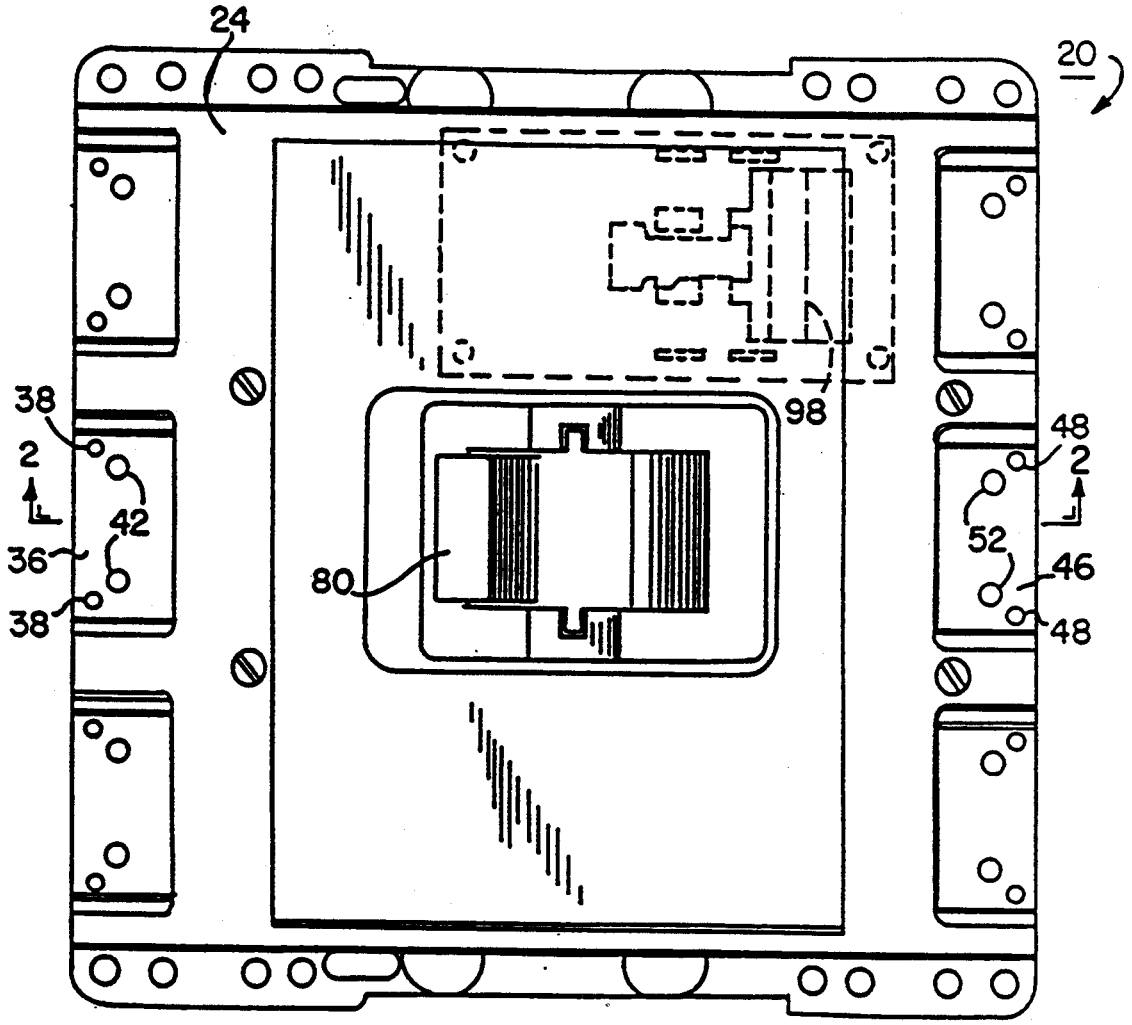
FIG. 1 is a plan view of a molded case circuit breaker in accordance with the present invention.

Referring to FIGS. 1, 2A, 2E and 3, a molded case circuit breaker 20 comprises an electrically insulated housing 21 having a molded base 22 and a molded coextensive cover 24, assembled at a parting line 26. The internal cavity of the base 22 is formed as a frame 28 for carrying the various components of the circuit breaker. However, the principles of the present invention are applicable to various types of molded case circuit breakers.

At least one pair of separable contacts 30 per phase are provided within the housing 21. More specifically, a main pair of contacts 30 are provided which include a fixed main contact 32 and a movable main contact 34. The fixed main contact 32 is electrically connected to a line side conductor 36, bolted to the frame 28 with a plurality of fasteners 38. A T-shaped stab 40 is fastened to the line side conductor 36 with a plurality of fasteners 42. A depending leg 44 of the stab 40 extends outwardly from the rear of the circuit breaker housing 21. This depending leg 44 is adapted to plug into a line side conductor disposed on a panelboard (not shown).

Similarly, the movable main contact 34 is electrically connected to a load side conductor 46 fastened to the frame 28 with a plurality of fasteners 48. Another T-shaped stab 50 is connected to the load side conductor 46 with a plurality of fasteners 52. A depending leg 53 of the stab 50, which extends outwardly from the rear of the circuit breaker housing 21, is adapted to plug into a load side conductor within the panelboard (not shown).

A donut-type current transformer (CT) 54 is disposed about the load side conductor 46. In a manner well known in the art, the current transformer 54 is used to detect current flowing through the separable contacts 30 of the circuit breaker 20 in order to provide a signal to an electronic trip unit 272 to trip the circuit breaker under certain conditions, such as a predetermined overload condition.

OPERATING MECHANISM

An operating mechanism 58 is provided for opening and closing the main contacts 30. The operating mechanism 58 includes a toggle assembly 60 which includes a pair of upper toggle links 62 and a pair of lower toggle links 64. Each upper toggle link 62 is pivotally connected at one end to a lower toggle link 64 about a knee-pin or pivot point 66. Each of the lower toggle links 64 are pivotally connected to a molded crossbar assembly 72 at a pivot point 70. A contact arm carrier 68 forms a portion of the crossbar assembly 72. The upper toggle links 62 are each pivotally connected to depending arms 73 of a cradle 74 at a pivot point 76. A pair of biasing springs 78 are connected between the pivot point 66 and an operating handle 80. The biasing springs 78 bias the toggle assembly 60 to cause it to collapse whenever the cradle 74 is unlatched from a latch assembly 82 causing the movable main contacts 34 to rotate about a cam roll pin assembly 176 to cause the main contacts 30 to separate. The handle 80 is integrally formed with an inverted U-shaped operating lever 106 which pivots about a pivot point 108.

The latch assembly 82 latches the cradle 74 and toggle assembly 60. The latch assembly 82 includes a lower latch link 84 and an upper latch link 86, pivotally connected end to end at a pivot point 88. The free end of the lower latch link 84 is pivotally connected to left and fight sideplates of frame 28 about a pivot point 90. The free end of the upper latch link 86 is pivotally connected to a latch lever 92 about a pivot point 94. The other end of the latch lever 92 is pivotally connected to the frame 28 about a pivot point 96.

Figure 2A:
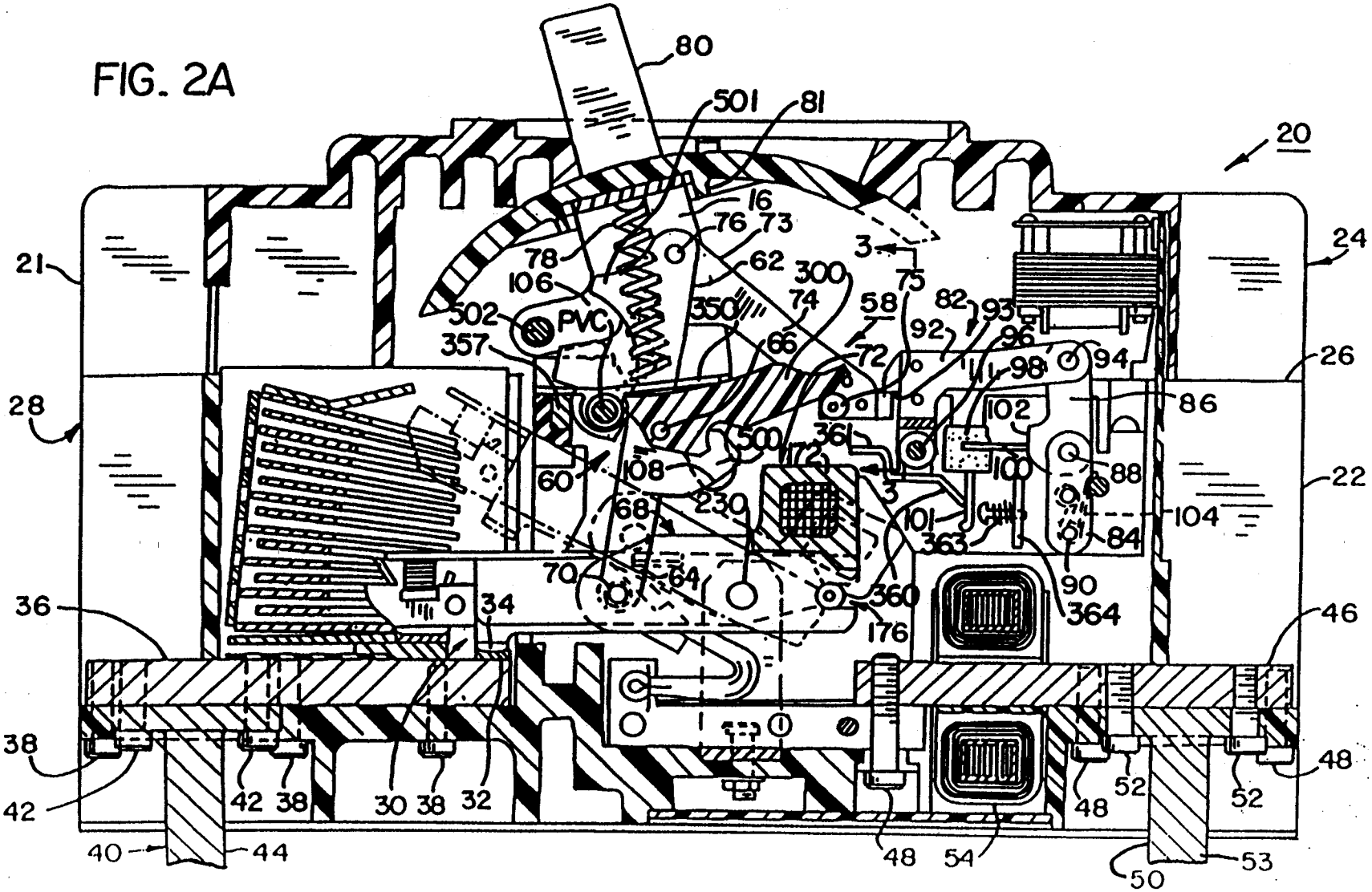
FIG. 2A is a vertical longitudinal view taken along line 2—2 of FIG. 1 according to one embodiment of the invention.

Operation of the latch assembly 82 is controlled by a trip bar 98 having depending levers 100,101 extending outwardly. The depending lever 100 engages a cam surface 102, formed on the lower end of the upper latch link 86, when the latch assembly 82 is in a latched position. In response to an overcurrent condition, the trip bar 98 of FIG. 2A is rotated clockwise to move the depending lever 100 away from the cam surface 102. Once the depending lever 100 has cleared the cam surface 102, a biasing spring 104, connected between the lower latch link 84 and the frame 28, causes the lower latch link 84 to toggle to the left (see FIG. 2D) and rotate counter-clockwise about pivot point 90. In turn, pivot point 88 toggles left, pivot point 94 toggles down and lower latching surface 93 of latch lever 92 rotates clockwise about pivot point 96, thereby releasing the cradle 74. Once the cradle 74 is released from the latch assembly 82, the cradle rotates counter-clockwise under the influence of the biasing springs 78. This causes the toggle assembly 60 to collapse which, in turn, causes the main contacts 30 to separate.

The trip bar 98 is controlled, for example, by the electronic trip unit 272 which actuates a solenoid 274 having a reciprocally mounted plunger 276. The plunger 276 engages the lever 100 which, in turn, causes the trip bar 98 to rotate in a clockwise direction to unlatch the latch assembly 82 (see FIG. 2D). The electronic trip unit 272 actuates the solenoid in response to predetermined overcurrent conditions sensed by the current transformer 54.

Figure 2B:
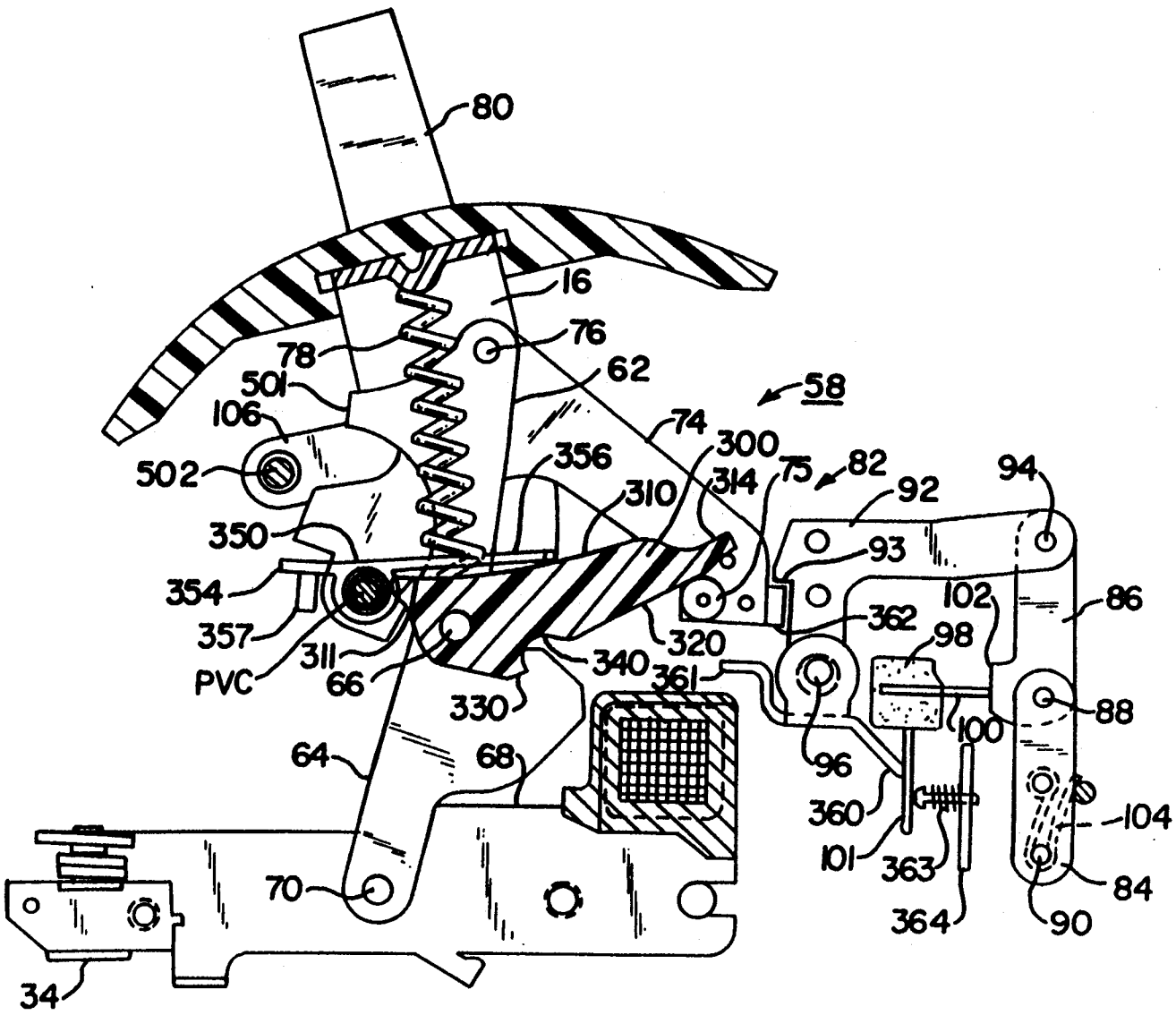
FIG. 2B shows an operating mechanism according to the embodiment of FIG. 2A when the circuit breaker is in an ON position.
Figure 2C:
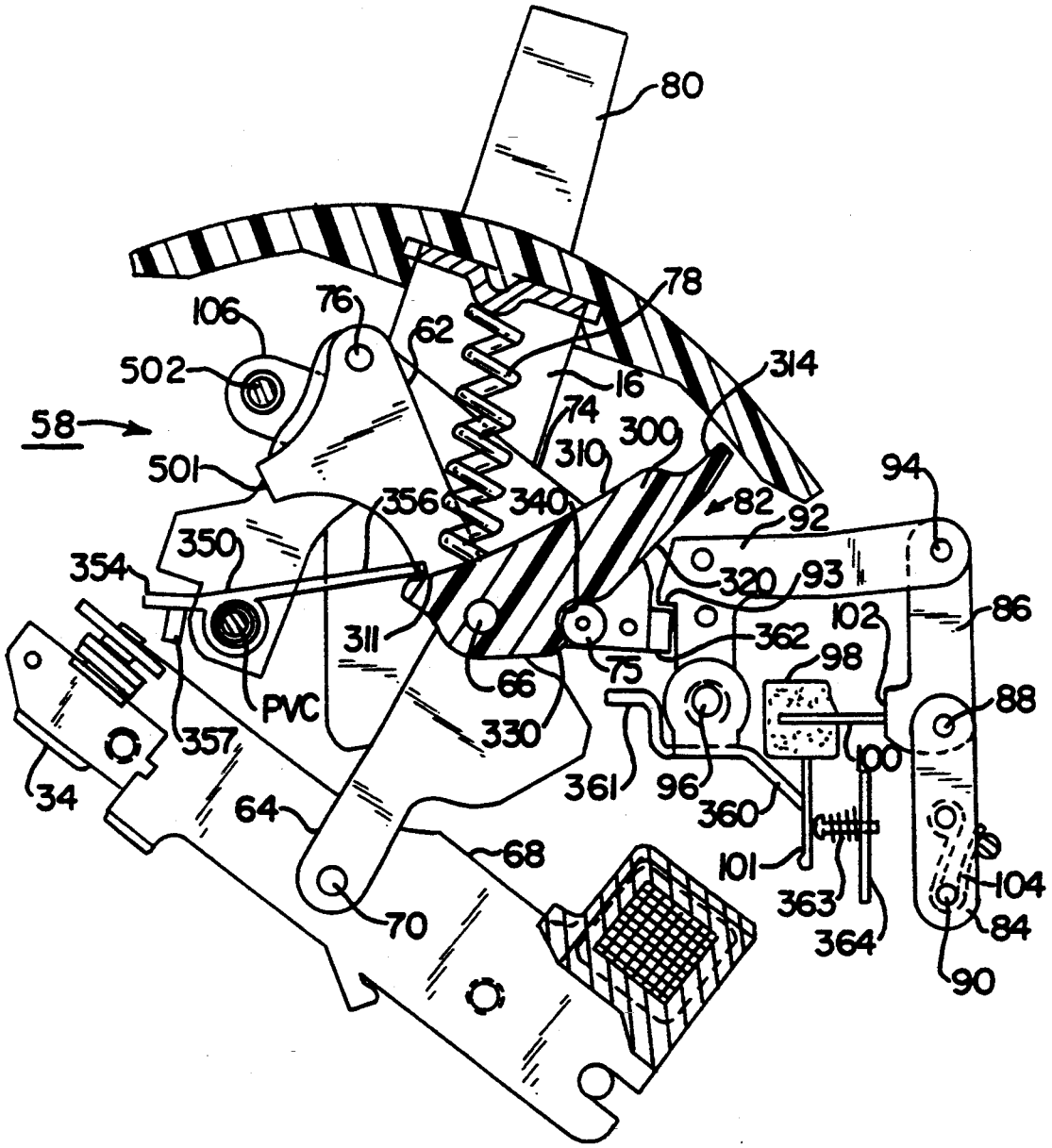
FIG. 2C shows the operating mechanism according to the embodiment of FIG. 2A when the circuit breaker is switched from the ON to an OFF position.
Figure 2D:
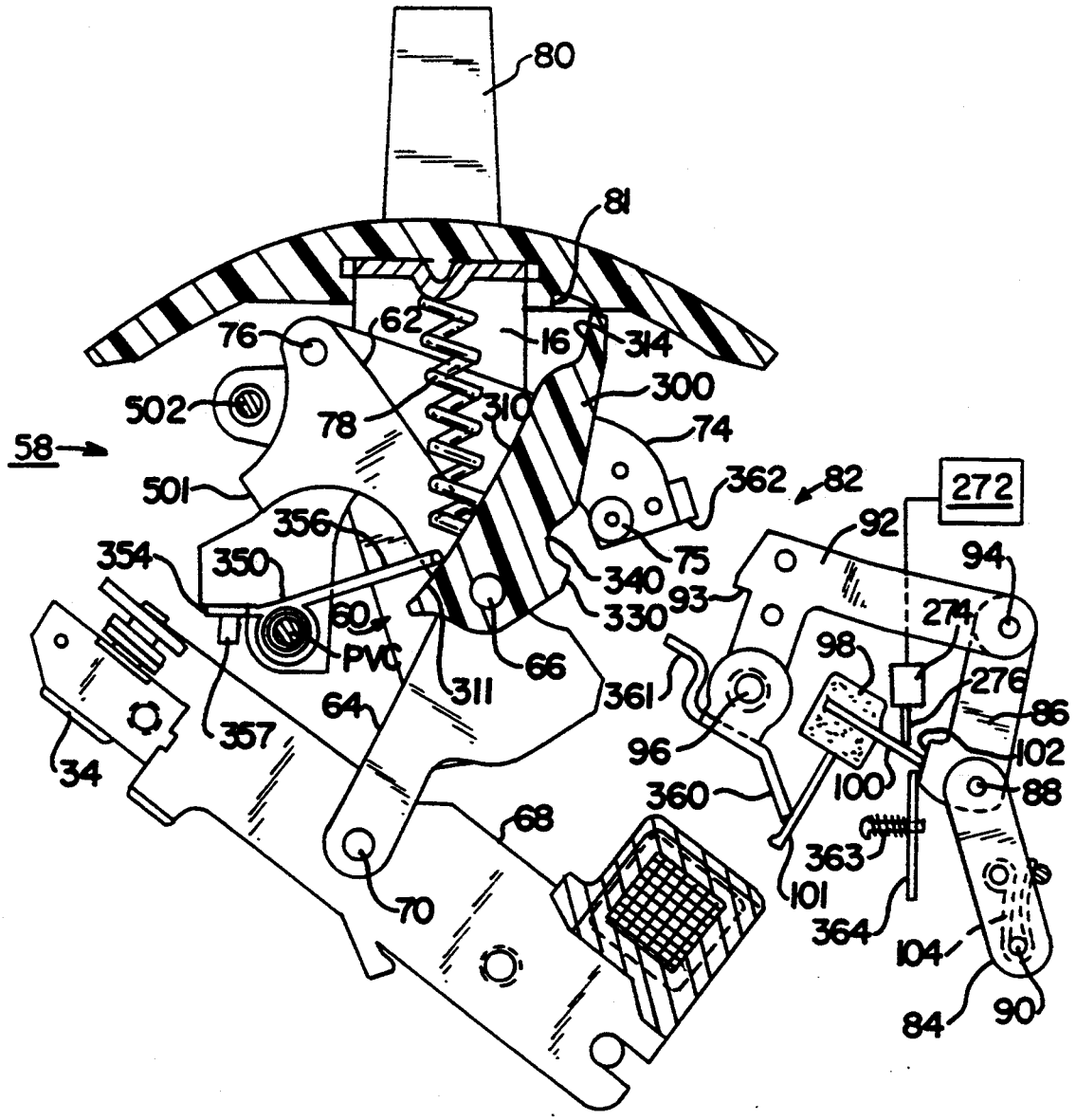
FIG. 2D shows the operating mechanism according to the embodiment of FIG. 2A when the circuit breaker is in a trip position.
Figure 2E:
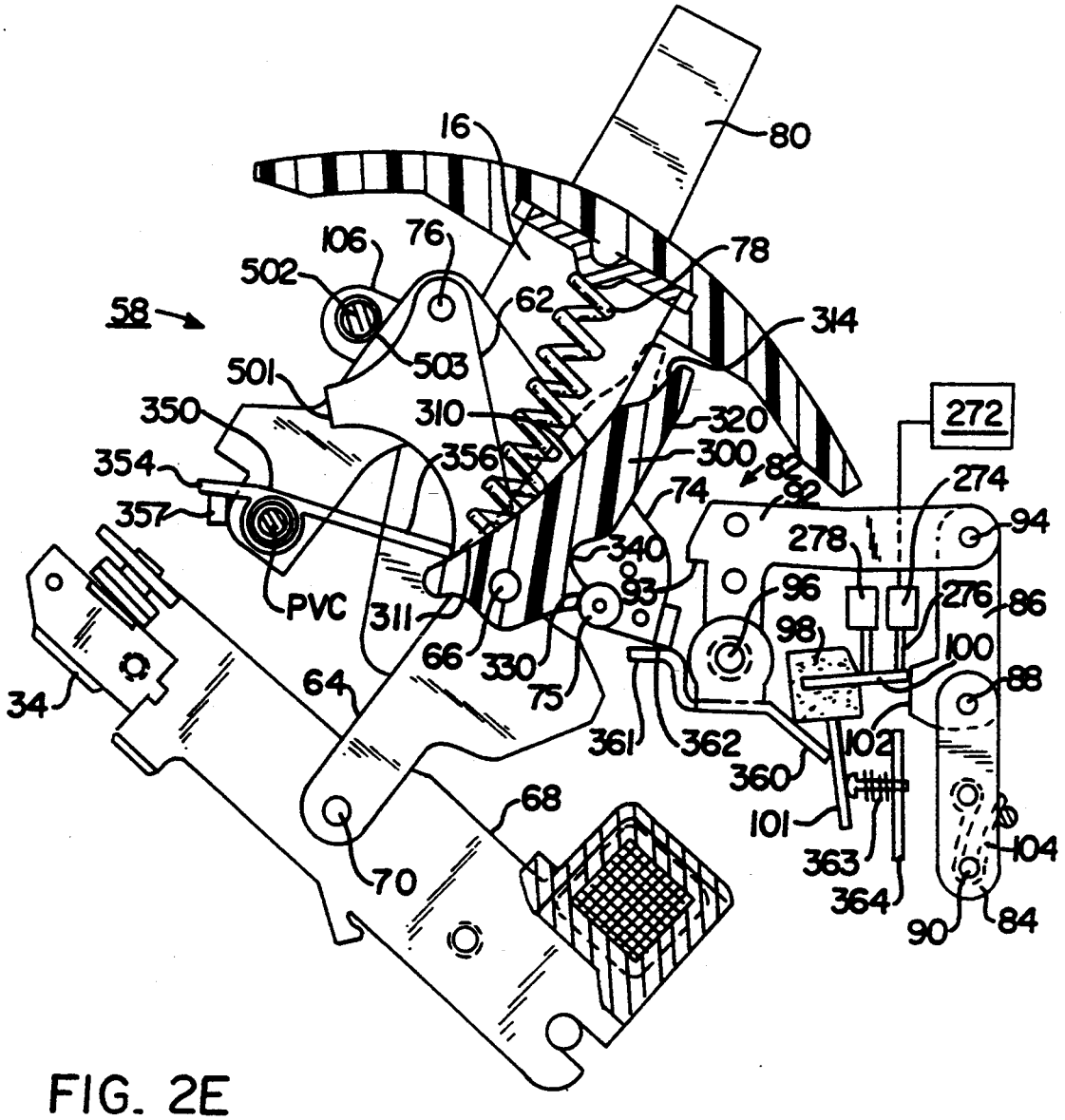
FIG. 2E shows the operating mechanism according to the embodiment of FIG. 2A when the circuit breaker is moved from the trip position to a fully reset position.

After the overcurrent condition has subsided, circuit breaker 20 may be reset to the ON position by moving operating handle 80 to the reset position of FIG. 2E, thereby resetting operating mechanism 58, and then moving operating handle 80 to the ON position of FIG.

2A, thereby closing the circuits of all poles of the circuit breaker. Although the exemplary circuit breaker has three poles, the principles of the present invention are applicable to a circuit breaker having any number of poles.

The current path through circuit breaker 20 may be manually opened and closed by moving operating handle 80 between its ON position and its OFF position. Operating mechanism 58 is positioned as shown in solid in FIG. 2A when operating handle 80 is in the ON position and moveable main contact 34 is in contact with fixed main contact 32, thereby allowing current flow through circuit breaker 20. As operating handle 80 is moved toward the OFF position from the ON position, biasing springs 78 apply a biasing force which is upward and to the fight on pivot point 66. In turn, the biasing force causes upper toggle link 62 to pivot counter-clockwise about pivot point 76. Also, lower toggle link 64 pivots clockwise about pivot point 70 and raises vertically. Such vertical action causes arm carrier 68 to pivot about carder pivot pin 230, thereby separating moveable main contact 34 from fixed main contact 32, and assume the position shown in shadow in FIG. 2A.

FIG. 2A shows a projection 500 which is an integral part of the lower toggle link 64. When the contacts 34 (the moveable contact) and 32 (the fixed contact) are welded, a crossbar assembly upper surface 172 remains where it was when the contacts were closed, and the projection 500 will encounter the upper surface 172 when, under operation of the toggle assembly 60, the lower toggle link 64 is forced to rotate about pivot point 70 in an attempt to fold.

As shown in FIG. 2A, tapper toggle link 62 includes a projection 501 turned on the left side of the line joining the pivots 70, 66 and 76 of the toggle assembly 60. In an ON to OFF transition of the handle 80, whenever the toggle assembly 60 is held in position by a welded contacts situation, as explained in detail in U.S. Pat. No. 5,200,724, a reset pin 502 of operating handle bar 16 rotates toward the cradle 74 and encounters the projection 501, thereby preventing the handle from going further into the OFF position which would be erroneous in such situation.

BLOCKING MECHANISM

Figure 3:
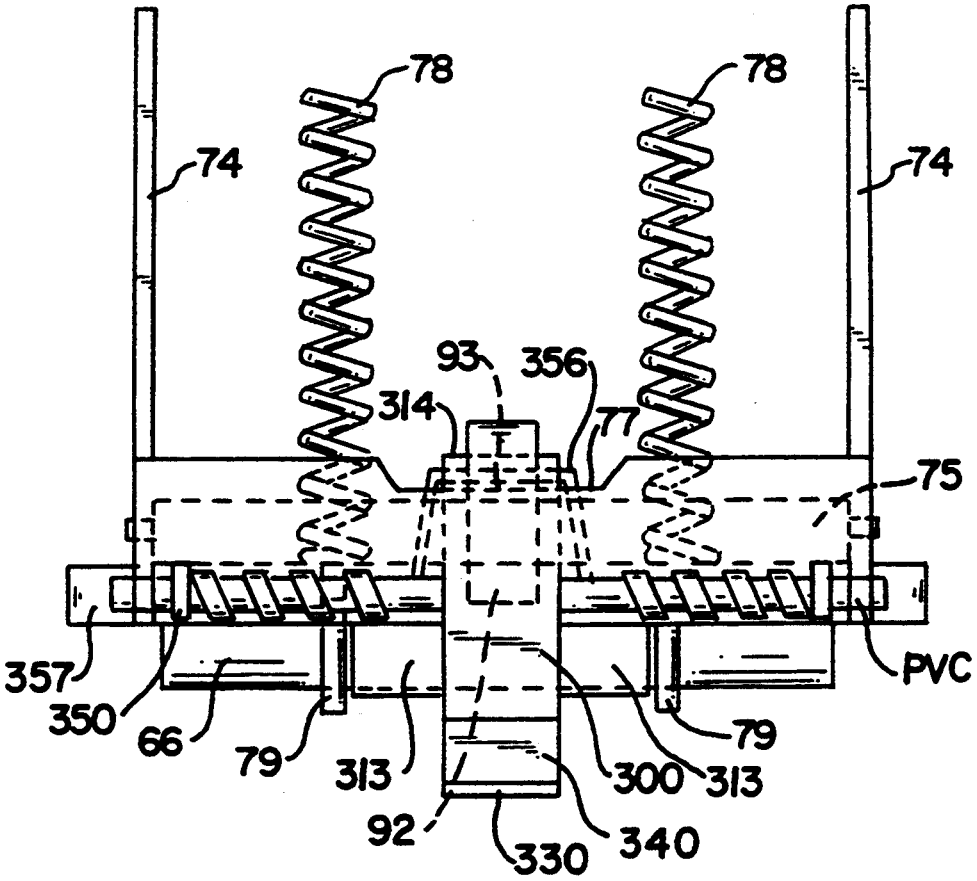
FIG. 3 is a cross-sectional view taken along line 3—3 of FIG. 2A and shows a blocking mechanism mounted to a pivot point between biasing springs.
Figure 5:
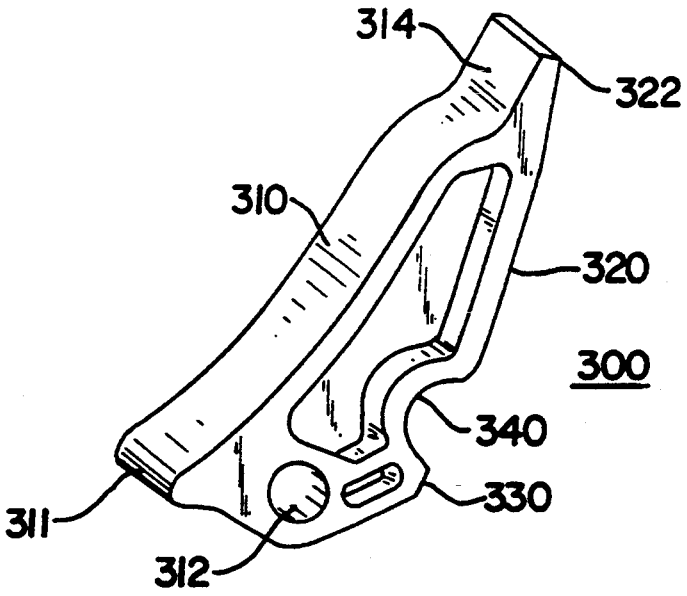
FIG. 5 shows a blocking mechanism in accordance with the invention.

Referring now to FIGS. 2A, 3 and 5, a blocking mechanism 300 is illustrated which, in the exemplary embodiment, is made of a suitably hard, non-brittle plastic. The blocking mechanism 300 is pivotally mounted to pivot point 66 by a mounting hole 312 and is separated from the two biasing springs 78 by two spacers 313. The biasing springs 78 are each mounted to pivot point 66 by an end tab 79. An upper surface 77 of cradle 74 is latched by lower latching surface 93 of latch lever 92.

An upper surface 310 of the blocking mechanism is generally arcuate. A generally flat lower surface 320 includes a camming surface 330 near mounting hole 312 and an adjacent arcuate holding surface 340. A spring mechanism 350 is mounted to a cross-pin PVC of cradle 74 and is biased at one end by an internal surface 357 of circuit breaker 20. The spring mechanism 350 generally biases and resists rotation of blocking mechanism 300 away from a second cross-pin 75 of cradle 74 when circuit breaker 20 is in the ON position of FIGS. 2A, 2B and 3.

In the exemplary embodiment, when operating mechanism 58 is moved from the ON position to the OFF position, cross-pin 75 of cradle 74 slides from an end 322 of the generally flat lower surface 320 toward arcuate holding surface 340. As operating mechanism 58 approaches the OFF position, arcuate holding surface 340 captures cross-pin 75 of cradle 74 (as shown in FIG. 2C) and prevents further downward motion of cradle 74 toward a reset lever 361 associated with a reset mechanism 360. In contrast, when operating mechanism 58 is moved from the trip position (as shown in FIG. 2D) to the reset position (as shown in FIG. 2E), camming surface 330 merely cams off of cross-pin 75 of cradle 74, thereby allowing handle 80 to move cradle 74 toward the reset lever 361.

Figure 6:
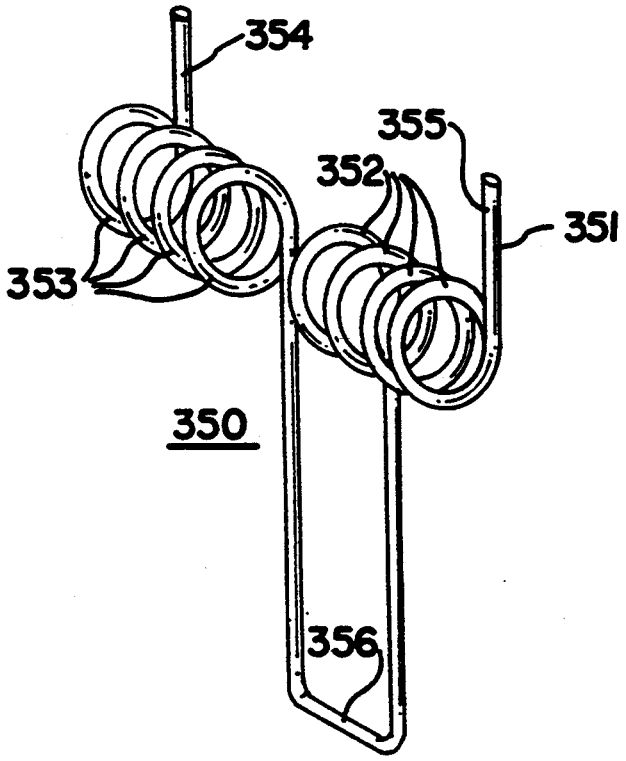
FIG. 6 shows a spring mechanism in accordance with the embodiment of FIG. 2A.

Referring now to FIG. 6, spring mechanism 350 is illustrated. In the exemplary embodiment, the spring mechanism 350 is formed from a hardened steel wire 351 which is 0.075 inches in diameter. Spring mechanism 350 is mounted to cross-pin PVC of cradle 74 using four right hand wire turns 352 and four left hand wire turns 353. The spring mechanism is biased against internal surface 357 of circuit breaker 20 by two spring ends 354,355. A center, U-shaped section 356 of the spring generally biases arcuate surface 310 of blocking mechanism 300, thereby preventing counter-clockwise rotation of the blocking mechanism in the ON position (as shown in FIG. 2B) and maintaining a generally vertical equilibrium position of the blocking mechanism in the trip position (as shown in FIG. 2D): Those skilled in the art will appreciate that the spring mechanism 350 may be formed in various manners, such as with a fiat metal band (not shown), rather than the exemplary wire 351, in order to prevent counter-clockwise rotation of the blocking mechanism in the ON position and maintain the generally vertical equilibrium position of the blocking mechanism in the trip position.

As illustrated in FIGS. 2D and 2E, spring mechanism 350 rotates blocking mechanism 300 counter-clockwise in order that the blocking mechanism assumes generally vertical positions whenever operating mechanism 58 is in the trip position or the reset position, respectively. Regardless of an orientation of circuit breaker 20. U-shaped section 356 presses end 311 of arcuate surface 310 downward and rotates blocking mechanism 300 counter-clockwise about pivot point 66. Also, in the ON position (as shown in FIG. 2B), section 356 bears on the arcuate surface 310 in order that lower surface 320 of blocking mechanism 300 rests in a generally horizontal position on cross-pin 75. Finally, in the ON to OFF position (as shown in FIG. 2C), arcuate surface 340 of blocking mechanism 300 holds cross-pin 75 in order that the blocking mechanism rests in a position between the generally vertical reset position and the generally horizontal ON position.

Referring now to FIG. 2B, the operating mechanism 58 is illustrated, in a manner similar to FIG. 2A, when circuit breaker 20 is in the ON position. The generally flat lower surface 320 of blocking mechanism 300 rests on cross-pin 75. The spring mechanism 350 is biased at end 354 (and end 355 as shown in FIG. 6) by internal surface 357. The section 356 at the other end of spring mechanism 350 generally biases upper surface 310 of blocking mechanism 300 and resists counter-clockwise rotation of the blocking mechanism from its generally horizontal position about pivot point 66.

FIG. 2C illustrates operating mechanism 58 after movement from the ON position to the OFF position. During this transition, cross-pin 75 of cradle 74 slides beneath lower surface 320 of blocking mechanism 300.

In a like manner as described above with FIG. 2B, during the transition, section 356 of spring mechanism 350 initially resists rotation of blocking mechanism 300 and forces lower surface 320 against cross-pin 75. As operating mechanism 58 approaches the OFF position of FIG. 2C, the lower arcuate holding surface 340 of blocking mechanism 300 captures cross-pin 75 and prevents further downward motion of cradle 74 toward reset lever 361. In this manner, reset lever 361 and reset mechanism 360 are not rotated about pivot point 96. Accordingly, trip bar 98 is not rotated, latch assembly 82 remains in a latched condition and operating mechanism 58 assumes the intended OFF position. In contrast, after ON to OFF operation, whenever handle 80 is moved from the OFF position to the reset position of FIG. 2E, blocking mechanism 300 withstands any handle forces between cross-pin 75 of cradle 74 and knee-pin 66, in order to permit further downward motion of cradle 74 toward, but without touching, reset lever 361.

Referring now to FIG. 2D, operating mechanism 58 is illustrated when circuit breaker 20 is in the trip position. Whenever circuit breaker 20 trips, pivot point 66 of toggle assembly 60 moves to the right and away from spring mechanism 350. In turn, section 356 of spring mechanism 350 bears on upper surface 310 of blocking mechanism 300 at a point to the left of pivot point 66, thereby rotating the blocking mechanism counter-clockwise about the pivot point 66 into the generally vertical position without contacting a lower surface 81 of handle 80. Regardless of any orientation of circuit breaker 20, section 356 presses downward near end 311 and maintains blocking mechanism 300 in equilibrium, as shown in FIG. 2D, where the blocking mechanism is separated from cross-pin 75. In such position, blocking mechanism 300 is passive and does not affect trip operation of circuit breaker 20.

The operating mechanism 58 of FIG. 2E illustrates handle 80 which has been moved to a fully reset position from the trip position of FIG. 2D. Whenever handle 80 transitions from the trip position to the reset position, section 356 of spring mechanism 350 first holds end 311 of blocking mechanism 300 before camming surface 330 cams off of the cross-pin 75 as shown in FIG. 2E. This occurs approximately midway between the trip and the reset positions. The generally vertical position of FIG. 2D is held, during trip to reset operation, until cross-pin 75 of cradle 74 drops beneath holding surface 340 of blocking mechanism 300. Contemporaneously, reset pin 502 of operating handle bar 16 rotates and engages a surface 503 of the cradle 74, which rotates clockwise, from its unlatched position toward its latched position, about pivot point PVC. As cradle 74 is rotated, a lower surface 362 of the cradle engages lever 361, which rotates reset mechanism 360 counter-clockwise about pivot point 96. In turn, reset mechanism 360 rotates depending lever 101 of trip bar 98 counter-clockwise to engage the cradle latch mechanism 82. As trip bar 98 rotates, an over-travel spring 363, which is biased against an internal surface 364 of the circuit breaker, resists and limits the counter-clockwise rotation of depending lever 101.

Similarly, other tripping mechanisms connected to trip bar 98, such as an undervoltage release mechanism 278, plunger 276, a flux transfer shunt trip device (not shown) and an attachment tab (not shown), are also compressed and further limit the counter-clockwise rotation of depending lever 101. The undervoltage release mechanism 278 opens the separable contacts 30 (see FIG. 2A) whenever the line voltage falls below a predetermined value. An example of an undervoltage release mechanism is disclosed in U.S. Pat. No. 4,489,295 issued Dec. 18, 1984 to James N. Altenhof, Jr. et al. entitled "Circuit Interrupter with Improved Electro-Mechanical Undervoltage Release Mechanism" and assigned to the assignee of the present invention, which is herein incorporated by reference. The shunt trip device (not shown) is comprised of a solenoid having a reciprocally mounted plunger disposed adjacent trip bar 98.

Under reset operation, as trip bar 98 rotates counter-clockwise, depending lever 100 of the trip bar engages cam surface 102 of tipper latch link 86 and opposes the biasing force of spring 104. This causes lower latch link 84 to toggle fight and rotate clockwise about pivot point 90. In turn, pivot point 88 toggles right, pivot point 94 toggles up, and latch lever 92 and lower latching surface 93 rotate counter-clockwise about pivot point 96, thereby latching cradle 74 in its latched position.

After this reset operation, circuit breaker handle 80 may be moved to the ON position in order to close the circuit breaker. In the ON position, blocking mechanism 300 assumes a generally horizontal position under the influence of spring mechanism 350 as described above with FIG. 2B. Alternatively, circuit breaker handle 80 may be moved to the OFF position in order to maintain an open condition of the separable contacts 30 (shown in shadow in FIG. 2A). Whenever operating mechanism 58 is moved from the reset position of FIG. 2E to the OFF position, blocking mechanism 300 rotates slightly counter-clockwise about pivot point 66 and assumes a slightly more vertical position (shown in shadow) than the reset position of FIG. 2E.

Figure 4A:
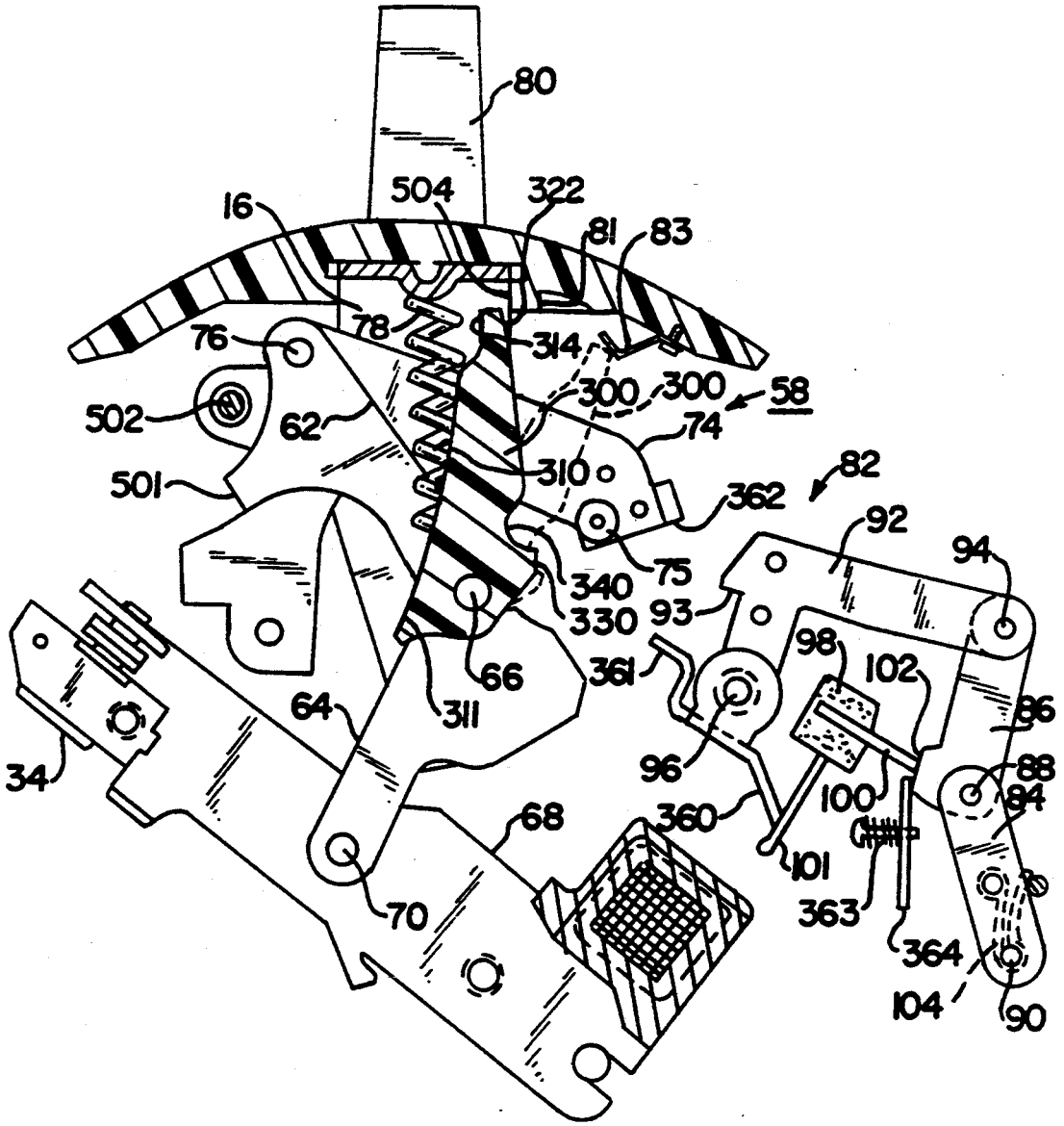
FIG. 4A shows an operating mechanism in accordance with an alternative embodiment of the invention when the circuit breaker is in a trip position.
Figure 4B:
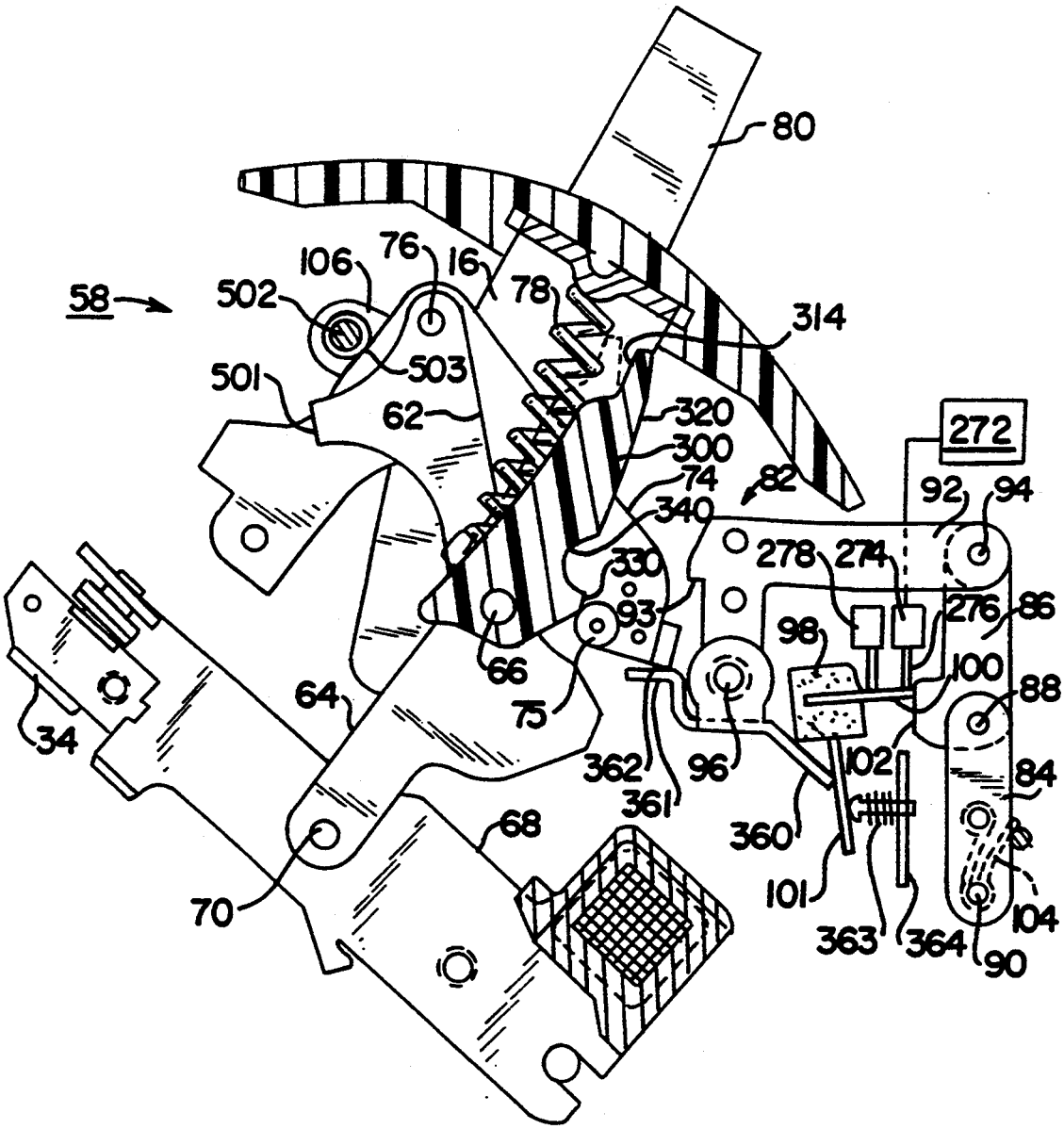
FIG. 4B shows the operating mechanism of FIG. 4A when the circuit breaker is moved from the trip position to a reset position.

Referring now to an alternative embodiment of FIGS. 4A and 4B, the operating mechanism 58 is illustrated in the trip and reset positions, respectively. FIGS. 4A–4B are generally similar to FIGS. 2D–2E except that spring mechanism 350 is not utilized. In this alternative embodiment, the circuit breaker must either be generally oriented as shown in FIGS. 2A–2E and 4A–4B or else must be generally vertically oriented with the (left) line side above the (right) load side. In the exemplary orientation, the force of gravity positions blocking mechanism 300 in the generally horizontal ON position of FIG. 2B. Gravity also positions the blocking mechanism in the ON to OFF intermediate cradle holding position of FIG. 2C and the reset to OFF position (shown in shadow) of FIG. 4B.

Continuing to refer to FIGS. 4A–4B, under conditions causing a trip of circuit breaker 20, cradle 74 is released by latch lever 92 and biasing springs 78 quickly move the cradle upward into the trip position shown in FIG. 4A. Also, cross-pin 75 of cradle 74, which is adjacent lower surface 320 of blocking mechanism 300 in the ON position of FIG. 2B, rotates the blocking mechanism counter-clockwise about pivot point 66. In contrast to FIG. 2D, where section 356 presses downward near end 311 and separates blocking mechanism 300 from cross-pin 75, during trip operation in the embodiment of FIG. 4A, an end surface 314 of the blocking mechanism rotates counter-clockwise, passes lower surface 81 of handle 80 and traps the other end surface 322 of the blocking mechanism to the left of a lower surface 504 of the handle. This generally vertical position of FIG. 4A is held, during trip to reset operation, until cross-pin 75 of cradle 74 drops beneath holding surface 340 of blocking mechanism 300. Further rotation of handle 80 toward the reset position of FIG. 4B releases the blocking mechanism which is then engaged by cross-pin 75 at camming surface 330.

Similarly, whenever circuit breaker 20 is reset, moved from the reset to the OFF position, and then manually tripped by a manual trip button (not shown) which rotates trip bar 98 clockwise, end surface 322 of blocking mechanism 300 rotates counter-clockwise and is captured by a retaining clip 83 on a lower surface of handle 80. This generally vertical position, shown in shadow in FIG. 4A, is held, during a trip to reset operation, until cross-pin 75 of cradle 74 drops beneath holding surface 340 of blocking mechanism 300. Further rotation of handle 80 toward the reset position releases the blocking mechanism which is then engaged by cross-pin 75 at camming surface 330.

Like FIG. 2D, blocking mechanism 300 is generally passive in the trip position of FIG. 4A and does not affect trip operation of circuit breaker 20. The reset position of FIG. 4B, and the reset to OFF position (shown in shadow), are substantially the same as the corresponding positions of FIG. 2E.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. A circuit breaker comprising:

an electrically insulating housing;

separable electrical contacts disposed within said housing and moveable between a closed position and an open position;

operating means for closing, opening and tripping open said separable contacts, said operating means having a handle arm for moving said operating means between an on position wherein said separable contacts are closed, an off position wherein said separable contacts are open, and a reset position which is beyond said off position, said operating means also having a trip position wherein said separable contacts are tripped open;

trip means cooperating with said operating means for sensing an electrical condition of said separable contacts and tripping said operating means to said trip position, in order to trip open said separable contacts in response to a predetermined electrical condition of said separable contacts; and blocking means for blocking movement of said operating means beyond said off position, when the handle arm moves said operating means from said on position to said off position.

2. The circuit breaker of claim 1 wherein said trip means includes latch means for latching said operating means when said operating means is in said on position, said off position and said reset position, said latch means responding to said trip means and unlatching said operating means in order that said operating means may enter said trip position.

3. The circuit breaker of claim 2 wherein said trip means includes further reset means for resetting said latch means in order that said latch means latches said operating means when said operating means is moved from said trip position to said reset position.

4. The circuit breaker of claim 3 wherein said operating means further has cradle means for operating said reset means and being latched by said latch means.

5. The circuit breaker of claim 4 wherein said separable contacts include a fixed contact and a moveable contact, and wherein said operating means further has crossbar means mechanically connected to said moveable contact and moveable therewith for assuming a projected position when said separable contacts are closed, said crossbar means also for assuming a retracted position when said separable contacts are open, said crossbar means cooperating with said cradle means in order that said separable contacts are opened when said operating means is in said trip position.

6. The circuit breaker of claim 5 wherein said operating means further has linkage means for operation including upper toggle link means pivotally mounted to said cradle means, lower toggle link means pivotally mounted to said crossbar means, and a knee-pin pivotally connecting said upper and said lower toggle link means; and wherein said blocking means is pivotally connected to said knee-pin.

7. The circuit breaker of claim 4 wherein said cradle means has a cross-pin cooperating with said blocking means for blocking movement, beyond said off position and toward said reset position, of said cradle means when the handle arm moves said operating means from said on position to said off position.

8. The circuit breaker of claim 4 wherein said blocking means has holding means for holding said cradle means when the handle arm moves said operating means from said on position to said off position.

9. The circuit breaker of claim 8 wherein said blocking means further has cam means for camming off of said cradle means in order that said handle arm moves said operating means between said trip position and said reset position which is beyond said off position.

10. The circuit breaker of claim 1 wherein said blocking means has a first position when said operating means is in said on position, a second position when said operating means is in said reset position, a third position when said operating means is in said trip position, and a fourth position, between said first position and said second position, when said operating means is moved from said on position to said off position.

11. The circuit breaker of claim 10 wherein said blocking means further has spring means for positioning said blocking means in order that said blocking means operates independently of an orientation of said circuit breaker.

12. The circuit breaker of claim 9 wherein said blocking means further has an arcuate proximate side and a distal side, said distal side having an arcuate surface for holding said cradle means when said operating means is moved from said on position to said off position, said cam means being located on said distal side and having a camming surface for camming off of said cradle means when said operating means is moved to said reset position.

13. The circuit breaker of claim 12 wherein said blocking means further has spring means for positioning said blocking means in order that said blocking means operates independently of an orientation of said circuit breaker.

14. The circuit breaker of claim 13 wherein said spring means is connected to a cross-pin of said cradle means.

15. The circuit breaker of claim 14 wherein said arcuate proximate side engages said spring means in order that said blocking means has a first position when said operating means is in said on position, a second position when said operating means is in said reset position, a third position when said operating means is in said trip position, and a fourth position, between said first position and said second position, when said operating means is moved from said on position to said off position.

16. The circuit breaker of claim 15 wherein said cradle means has a second cross-pin cooperating with said arcuate surface of said distal side of said blocking means to hold said cradle means when the handle arm moves said operating means from said on position to said off position.

17. The circuit breaker of claim 16 wherein said blocking means has a fifth position, between said second position and said third position, when said operating means is moved from said reset position to said off position.

18. The circuit breaker of claim 10 wherein said blocking means has a fifth position, between said second position and said third position, when said operating means is moved from said reset position to said off position.

19. The circuit breaker of claim 10 wherein said handle arm has means for holding said blocking means in said third position when said operating means is in said trip position.

* * * * *